US010525498B2

(12) United States Patent
Jung et al.

(10) Patent No.: US 10,525,498 B2
(45) Date of Patent: Jan. 7, 2020

(54) SLOT COATING APPARATUS WITH IMPROVED COATING BEAD REGION

(71) Applicant: KOREA UNIVERSITY RESEARCH AND BUSINESS FOUNDATION, Seoul (KR)

(72) Inventors: Hyun Wook Jung, Seoul (KR); Byoung Jin Chun, Seoul (KR); Kwan Young Lee, Seoul (KR); Jin Seok Park, Seoul (KR); Gi Wook Lee, Suwon-si (KR); Won Gi Ahn, Hwaseong-si (KR)

(73) Assignee: Korea University Research and Businss Foundation, Seoul (KR)

( * ) Notice: Subject to any disclaimer, the term of this patent is extended or adjusted under 35 U.S.C. 154(b) by 0 days.

(21) Appl. No.: 16/023,270

(22) Filed: Jun. 29, 2018

(65) Prior Publication Data

US 2019/0160485 A1 May 30, 2019

(30) Foreign Application Priority Data

Nov. 24, 2017 (KR) ..... 10-2017-0158882

(51) Int. Cl.
*B05C 5/02* (2006.01)

(52) U.S. Cl.
CPC ..... *B05C 5/0254* (2013.01)

(58) Field of Classification Search
None
See application file for complete search history.

(56) References Cited

U.S. PATENT DOCUMENTS 2,681,294 A * 6/1954 Beguin ..... D06N 3/0088 430/523
6,383,571 B1 * 5/2002 Muhlfriedel ..... B05C 5/0254 118/407

FOREIGN PATENT DOCUMENTS

KR 10-2016-0010808 A 1/2016
KR 10-1666865 B1 10/2016

OTHER PUBLICATIONS

Korean Office Action dated Feb. 1, 2019 in counterpart Korean Patent Application No. 10-2107-0158882 (2 pages in English and 4 pages in Korean).

* cited by examiner

*Primary Examiner* — Jethro M. Pence
(74) *Attorney, Agent, or Firm* — NSIP Law

(57) ABSTRACT

A slot coating apparatus having an improved coating bead region is disclosed. An embodiment of the invention provides a slot coating apparatus configured to coat a coating liquid containing a high concentration of particles over a substrate, where the slot coating apparatus includes: a first slot die that is arranged at a downstream side of the coating liquid; a second slot die that is arranged at an upstream side of the coating liquid and is positioned facing the first slot die; a coating bead cover that extends from one side of the first slot die along a movement direction of the substrate; and a pressure adjustment device that is disposed at the second slot die side and is configured to form a pressure gradient between the downstream and the upstream.

11 Claims, 8 Drawing Sheets

SLOT COATING APPARATUS WITH IMPROVED COATING BEAD REGION

CROSS-REFERENCE TO RELATED APPLICATIONS

This application claims the benefit of Korean Patent Application No. 10-2017-0158882, filed with the Korean Intellectual Property Office on Nov. 24, 2017, the disclosure of which is incorporated herein by reference in its entirety.

BACKGROUND

1. Technical Field

The present invention relates to a slot coating apparatus having an improved coating bead region.

2. Description of the Related Art

With advances in industry and movements toward products of smaller size and greater precision in recent times, there is a rapid increase in user demands relating to the level of precision and specific functionality required for materials. As such, there have been numerous attempts to resolve the various problems that occur during coating procedures. Some major examples may include anti-reflection and hydrophobic films, as well as flexible electrodes used with conductive particles included in the coating liquid, where such examples were developed for the purpose of improving optical or electrical properties.

Typically, methods such as direct gravure coating, micro-gravure coating, curtain coating, slot coating, etc., are used to apply a coating material diluted in a solvent.

Among these methods, slot coating is typically often used in order to improve coating uniformity.

Unlike other coating methods, slot coating adopts a structure that is closed off from the supply part to the ejector part of the material.

Slot coating is considered very useful, because it can fundamentally avoid the problems of the thickness of the coating becoming uneven and the coating material becoming altered due to the volatilization of the dilution solvent, and because the coating thickness can be readily adjusted by way of the die gap.

With conventional methods of slot coating, even if the slurry or suspension containing a high concentration of catalyst particles is distributed uniformly, interactions between particles cause a higher concentration of particles towards a lower shear speed in a flow having a non-uniform shear speed, ultimately resulting in a non-uniform distribution of particles.

Since the flow of coating includes a flow of non-uniform shear speed, even a fluid in which the high concentration of particles are well distributed suffers from an uncontrollable non-uniformity of particles over the substrate being coated as the fluid passes through portions where there is non-uniform shear speed.

DOCUMENTS OF THE RELATED ART

Korean Patent Publication No. 10-2004-0030517

SUMMARY OF THE INVENTION

To resolve the problems of the related art described above, an aspect of the invention aims to provide a slot coating apparatus having an improved coating bead region that is capable of manufacturing a film in which the particles are distributed in a regular manner over the substrate by adjusting the distribution of particles during the slot coating.

To achieve the objective above, an embodiment of the invention provides a slot coating apparatus configured to coat a coating liquid containing a high concentration of particles over a substrate, where the slot coating apparatus includes: a first slot die that is arranged at a downstream side of the coating liquid; a second slot die that is arranged at an upstream side of the coating liquid and is positioned facing the first slot die; a coating bead cover that extends from one side of the first slot die along a movement direction of the substrate; and a pressure adjustment device that is disposed at the second slot die side and is configured to form a pressure gradient between the downstream and the upstream.

The length (L) of the coating bead cover can be proportional to the coating gap size (H), which represents the distance between a die lip of the first slot die and second slot die and a surface of the substrate.

L can be within the range of 10H to 2000H.

A more desirable result can be obtained when L is within the range of 100H to 1000H.

The length (L) of the coating bead cover can be varied according to the pressure gradient and the movement speed of the substrate.

The flow of the coating liquid can be classified as a Couette flow, a boundary flow, and a Poiseuille flow based on a dimensionless variable that is affected by the pressure gradient, a coating gap size (H) representing a distance between a die lip of the first slot die and second slot die and a surface of the substrate, a substrate movement speed, and a slurry viscosity.

The dimensionless variable can be expressed by the equation shown below:

$$G = \frac{\nabla p H^2}{u_w \eta_s}$$

where $\nabla p$ is the pressure gradient along the axial direction, H is the gap size between the die lip and the substrate, $u_w$ is the substrate movement speed, and $\eta_s$ is the viscosity of the slurry.

For the crystallization of the particles of the coating liquid, the dimensionless variable can be determined as a value within a range of 0.8 to 1.2

An embodiment of the invention provides a coating bead cover that extends in the movement direction of the substrate, whereby the particles can be coated with a more regular structure over the substrate.

Additional aspects and advantages of the present invention will be set forth in part in the description which follows, and in part will be obvious from the description, or may be learned by practice of the invention.

DETAILED DESCRIPTION OF THE INVENTION

Figure 1:
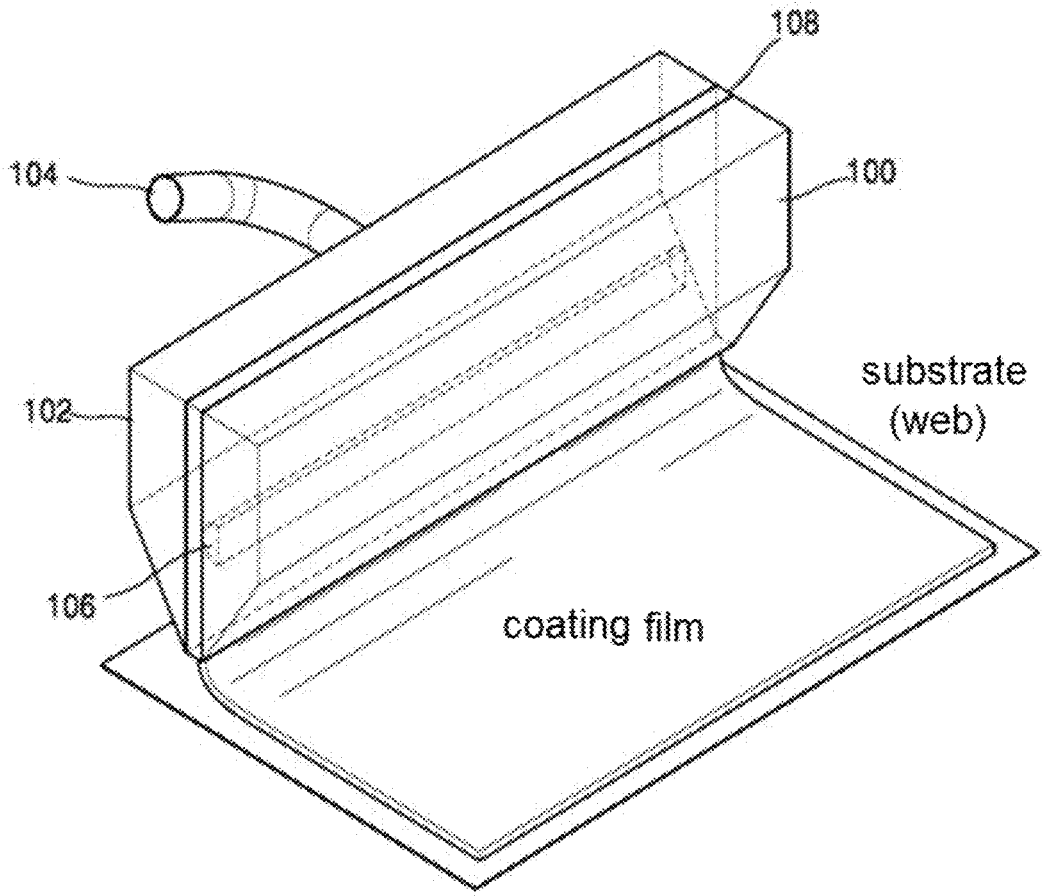
FIG. 1 CONVENTIONAL ART
FIG. 1 illustrates the structure of a typical slot coating apparatus.

As the invention allows for various changes and numerous embodiments, particular embodiments will be illustrated in the drawings and described in detail in the written description.

However, this is not intended to limit the present invention to particular modes of practice, and it is to be appreciated that all changes, equivalents, and substitutes that do not depart from the spirit and technical scope of the present invention are encompassed in the present invention. In describing the drawings, like reference numerals are used for like elements.

The present invention relates to a slot coating apparatus that is capable of adjusting the distribution of particles when a solution containing a high concentration of particles (particle volume percentage of 20% or higher) is coated over a substrate. More specifically, a slot coating apparatus having an improved structure is provided, to control the distribution of particles resulting from the interactions between the particles within the fluid and the flow properties of the fluid, such that the particles suspended over the substrate form a more regular array.

FIG. 1 illustrates the structure of a typical slot coating apparatus.

As illustrated in FIG. 1, a slot coating apparatus may include a first slot die (slot die upper plate) 100 and a second slot die (slot die lower plate) 102.

At the second slot die 102, a supply part 104 is connected through which to supply the coating liquid, and a chamber 106 is formed for storing the supplied coating liquid.

The target onto which the coating liquid ejected from within the slot die is applied is referred to as a web, substrate, or a support layer. In the descriptions that follow, the target onto which the coating liquid is applied is referred to as the substrate.

In order to form a coating film that is uniform along the direction of progression, the line speed and pressure have to be suitably controlled in accordance to the flow amount of the coating liquid being ejected.

The coated film has to display uniform coating properties in both the progression direction and the lateral direction. Thus, a suitable slot die is needed that considers not only the appropriate process adjustment variables but also the properties of the solution.

Figure 2:
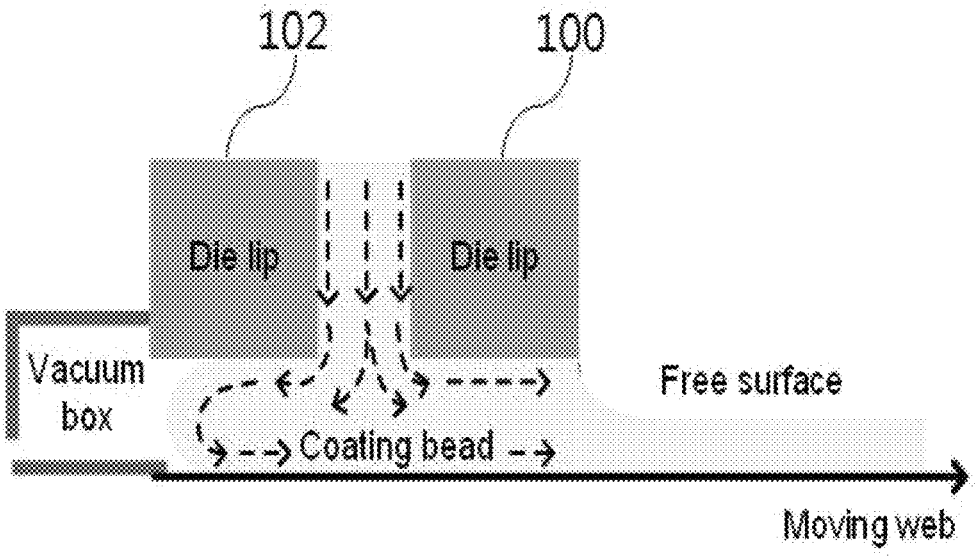
FIG. 2 CONVENTIONAL ART
FIG. 2 illustrates a slot coating apparatus according to the related art.
Figure 3:
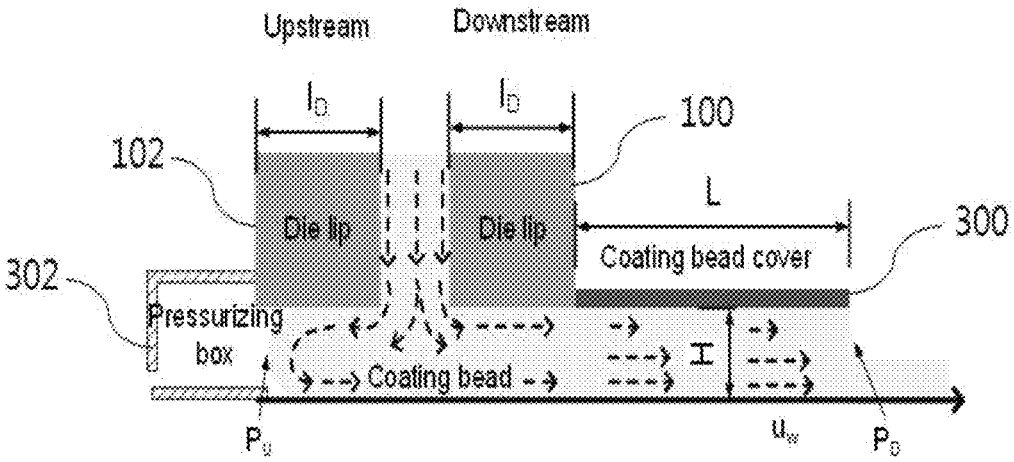
FIG. 3 illustrates a slot coating apparatus according to an embodiment of the invention.

FIG. 2 illustrates a slot coating apparatus according to the related art, while FIG. 3 illustrates a slot coating apparatus according to an embodiment of the invention.

Referring to FIG. 2 and FIG. 3, when the coating liquid is ejected from the feed slit between the first slot die 100 and second slot die 102, the region between the feed slit and the substrate may be defined as the coating bead region.

According to the related art, the movement of the substrate may cause the right side of the first slot die 100 (the movement direction of the substrate) to have a free space, while the left side of the second slot die 102 (the opposite direction of the movement of the substrate) may be maintained at a vacuum pressure.

However, such conventional slot coating suffers from an unavoidable non-uniform distribution of particles, because during the application of a coating liquid having a high concentration of particles, interactions between the particles in a flow having a non-uniform shear speed cause the parts having lower shear speeds to have higher concentrations.

To control this phenomenon, an embodiment of the invention provides a coating bead cover 300 of a particular length at the first slot die 100 side.

The coating bead cover 300 causes the flow speed at the cover surface to effectively become 0, so that a Couette-Poiseuille flow may be maintained continuously in the coating bead region.

The length of the coating bead cover 300 may be variably adjusted according to the pressure gradient and the speed of the substrate (moving web speed).

Due to the coating bead cover 300, the pressure gradient applied on the fluid may be increased compared to the existing structure. In order to maintain a static contact line in such pressurized flow, a pressure adjustment device 302 may be provided on the second slot die 102 side.

The pressure at the pressure adjustment device 302 can be lower or higher than the atmospheric pressure depending on the conditions of the flow.

It is known that a solution containing a high concentration of particles (particle volume percentage of 20% or higher) experiences additional diffusion due to interactions between the particles. Although such a phenomenon of particle diffusion would help the particles to form a uniform distribution if the shear speed within the flow is uniform overall, in the case of a flow having a non-uniform shear speed, the phenomenon causes additional particle diffusion from regions having high shear speeds locally to regions having lower shear speeds. A representative example of a flow having non-uniform shear speeds is the Poiseuille flow, which occurs due to pressure differences in a fluid flowing through a tubular channel. Since a Poiseuille flow has a higher shear speed at the wall surface and a lower shear speed at the center of the channel, non-uniformity would occur, as the center part of the channel would have a higher concentration and the wall surface of the channel would have a lower concentration.

In slot coating also, the flow passing through the feed slot would have the properties of a Poiseuille flow, with particles moving toward the center part. After passing through the feed slot and in the coating bead region, the flow may assume the form of a Couette-Poiseuille flow, as the impact of the moving substrate creates composite forces resulting from the pressure differences and the pulling by the wall surface. In this flow, the distribution of particles may no longer have a high concentration at the center part but rather may depend on the movement speed of the moving substrate, the pressure gradient, and the slurry viscosity, where the relationship may be expressed as a dimensionless variable as shown below.

$$G = \frac{\nabla p H^2}{u_w \eta_s} \quad \text{[Equation 1]}$$

Here, $\nabla p$ is the pressure gradient along the axial direction, H is the gap size between the die lip and the substrate, $u_w$ is the substrate movement speed (web speed), and $\eta_s$ is the viscosity of the slurry (suspension).

For the crystallization of the particles of the coating liquid, the dimensionless variable can be determined as a value within a range of 0.8 to 1.2

Here, when the slurry has the form of particles suspended in a Newtonian fluid, the following Krieger model can be expressed from the viscosity (i) of the Newtonian fluid.

$$\eta_s = \eta(1-\phi/\phi_m)^{-c} \quad \text{[Equation 2]}$$

Here, the volume fraction for maximum packing $\varphi_m$=0.68 and c=1.82 are typically used.

According to the G value of Equation 1, the properties of a Couette-Poiseuille flow may be classified into one of the following three types.

1) Couette dominant flow (G<<1): the flow is formed mainly by the movement of the substrate, and as the overall flow properties approach those of a Couette flow, the shear distribution within the flow is somewhat uniform.

2) Boundary flow (G~1): the flow is of a boundary between a Couette flow and a Poiseuille flow (i.e. a Couette-Poiseuille flow), and as the forces associated with the movement of the substrate and the pressure gradient are somewhat of similar magnitudes, the flow is affected by both of these forces. The shear distribution within the flow exhibits a low shear speed at the substrate side.

3) Poiseuille dominant flow (G>>1): the flow is similar to a Poiseuille flow, which is a flow passing through a channel by way of a pressure gradient. In a complete Poiseuille flow, the shear speed is the lowest at the center of the coating gap and is higher at the substrate surface and the die lip.

A common occurrence in the flows of fluids containing high concentrations of particles is that the particles move from regions of higher shear speed to regions of lower shear speed, and an embodiment of the invention proposes an apparatus that can control this phenomenon of particle movement based on the properties displayed by the three types of flow according to the pressure gradient and substrate movement speed.

Additionally, the pressure value $P_U$ for securing the meniscus at a fixed position upstream can be expressed as a simplified equation that depends on changes in the length L of coating bead cover.

$$P_U = \left(q - \frac{u_w H}{2}\right)\frac{12\eta_s(l_D + L)}{H^3} - \frac{6\eta_s u_w l_D}{H^2} + P_D \quad \text{[Equation 3]}$$

Here, q is the specific volume flow rate, which is equal to the total volume flow rate divided by the coating width W. $l_D$ represents the length of the die lip, and the remaining constants and variables are as described previously.

In Equation 3, the downstream pressure $P_D$ may be the pressure at a free surface and therefore may be atmospheric pressure. That is, the required upstream pressure relative to atmospheric pressure can be estimated from Equation 3.

The first term on the right side is the pressure value obtained downstream by a Couette-Poiseuille flow, and the second term is the pressure value from recirculation upstream. Thus, it can be seen that, with methods based on the related art (L=0), many cases would require a negative pressure and would hence require a vacuum box. With an embodiment of the invention, however, the presence of the coating bead cover having a relatively long length may result in a need for a positive pressure and therefore a pressure adjustment device 302.

Equation 3 is a simplified equation that employs many assumptions. Therefore, in actual operation, readjustments may be needed, after using the pressure value obtained from the equation as an initial value. (According to some of the assumptions, the equation ignores variables associated with the dependence of the viscosity value on shear speed, the pressure difference caused by the surface tension of the slurry resulting from the high viscosity, and the entrance effect.)

EMPIRICAL EXAMPLES

The coating bead region is essentially of a sub-millimeter scale. The feed slot gap and the coating gap (distance between the slot die and the substrate) are several hundred micrometers, and the thickness of the coating layer on the substrate after drying is about several tens of micrometers. The substrate movement speed is typically several tens of m/min. The applied coating liquid is typically hardened by a drying or a hardening thermal treatment.

In terms of flow properties, the flow from a slot coating apparatus may first be a Poiseuille flow that is motivated by a pressure difference, may then reach the coating bead region where the movement of the substrate and the pressure difference impact the flow simultaneously (as for a Couette-Poiseuille flow), and may reach a free flow region where only the substrate is passing (as for a free surface flow).

Generally, since the density difference between suspended particles is not great in the particle-containing slurry used as the coating liquid, sedimentation caused by gravitation can be easily ignored.

The solution used in the experiments is a Newtonian fluid formed by mixing glycerin and water in a ratio of 6:4. Here, a Newtonian fluid refers to a fluid in which a change in shear speed does not cause a change in viscosity. The viscosity of the fluid was measured as $\eta$=50 mPa·s using an Anton Paar MCR301 rheometer. It was assumed that the particles used are 40 wt % of spherical polystyrene particles (D50=10 μm). Since the polystyrene particles have a density that is virtually the same as that of the solvent, the volume percentage may be obtained as 40 vol %.

Experiments were performed under the following three types of conditions according to pressure gradient and substrate movement speed.

TABLE 1

| Condition | L [cm] | ∇p [Pa/m] | $u_w$ [m/min] | G | Crystallization |
|---|---|---|---|---|---|
| IA | 0 | $1.2 \times 10^5$ | 3 | 0.6 | x |
| IB | 10 | | | | x |
| IIA | 0 | $2.0 \times 10^5$ | 3 | 1.0 | x |
| IIB | 10 | | | | ○ |
| IIIA | 0 | $1.0 \times 10^6$ | 3 | 5.0 | x |
| IIIB | 10 | | | | x |

Looking at the G values obtained for the respective conditions, it can be seen that I represents a Couette dominant flow region, II represents a boundary flow (Couette-Poiseuille flow) region, and III represents a Poiseuille dominant flow region. A and B represent apparatuses based on the related art and an embodiment of the invention, respectively.

As regards whether or not there is particle crystallization for the six sets of conditions listed above, it is observed that particle crystallization occurs only for the IIB condition. An explanation for this is as follows.

For each of the conditions, drawings are provided that illustrate the flow rate distribution, particle distribution, and particle crystallization up to two layers with respect to particle diameters over the film, where the height direction from the substrate surface towards the die lip at the die gap is defined as the y direction.

Figure 4A:
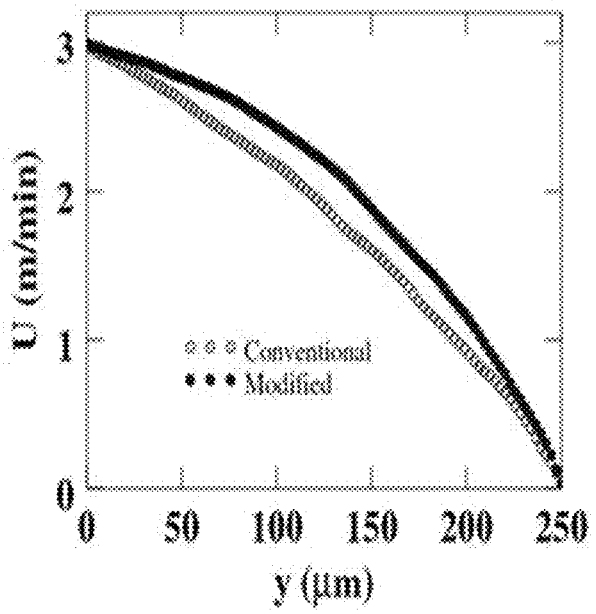
FIG. 4A illustrates flow speeds in a Couette dominant flow.
Figure 5A:
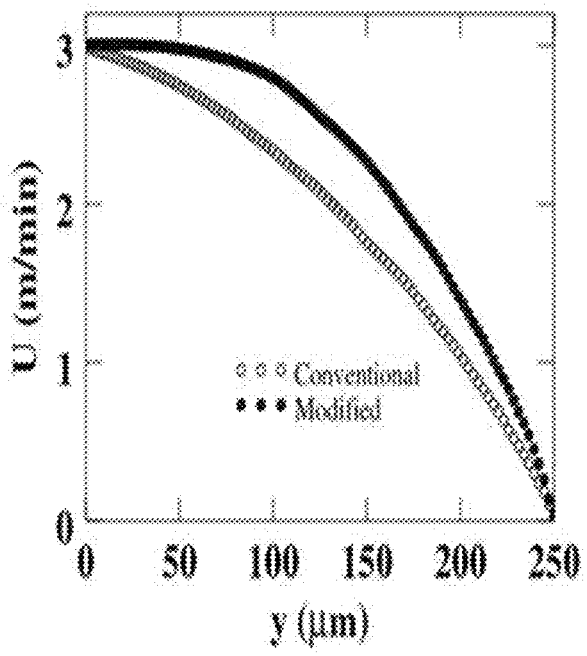
FIG. 5A illustrates flow speeds in a boundary flow.
Figure 6A:
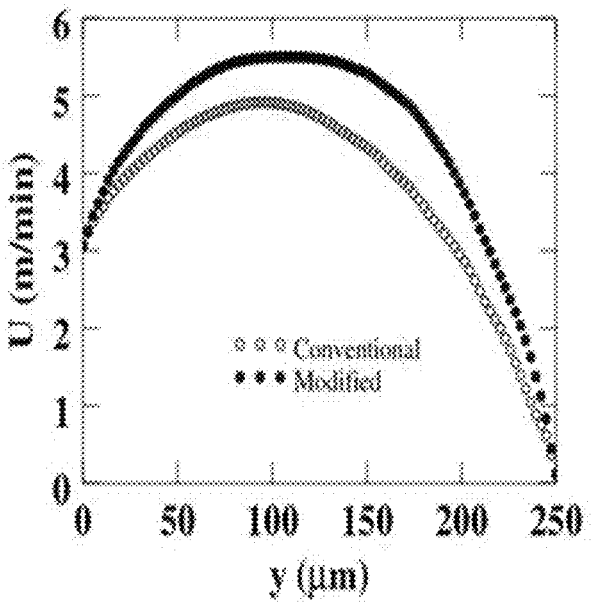
FIG. 6A illustrates flow speeds in a Poiseuille dominant flow.

It is observed that the flow speeds at the end of the die lip, immediately before free surface flow begins, may follow the graphs of FIG. 4A, FIG. 5A, and FIG. 6A. It can be seen that, compared to an apparatus based on the related art, a slot coating apparatus according to an embodiment of the invention can provide a more fully developed flow distribution of the suspension, due to the flow through a longer section.

In FIGS. 4A to 6A and FIGS. 4B to 6B, 'Conventional' represents the flows and concentration distributions obtained according to the related art, whereas 'Modified' represents the flows and concentration distributions obtained with the present embodiment.

It can be observed that all flow speed distributions satisfy the conditions of $U=u_w$ at the substrate surface (y=0) and no slip (U=0) at the surface of the die lip or cover (y=H).

Changes in the flow distribution cause changes in local shear speeds, which in turn cause changes in particle distribution.

Figure 4B:
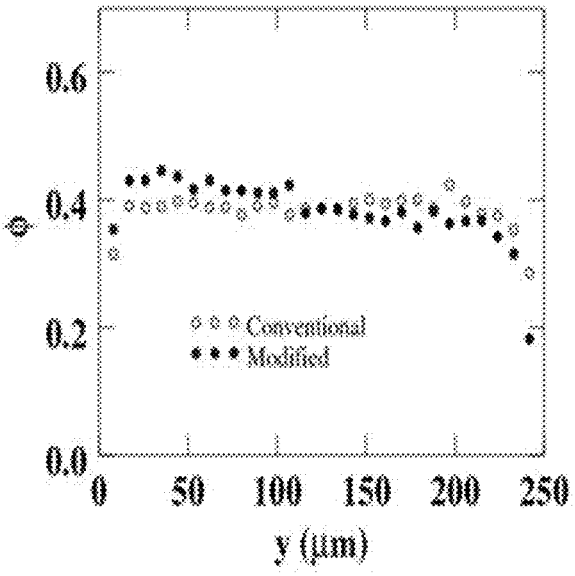
FIG. 4B illustrates particle concentration distributions in a Couette dominant flow.
Figure 5B:
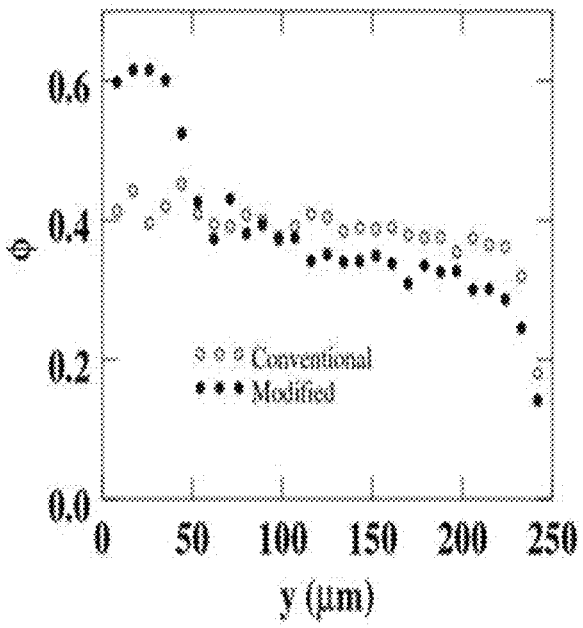
FIG. 5B illustrates particle concentration distributions in a boundary flow.
Figure 6B:
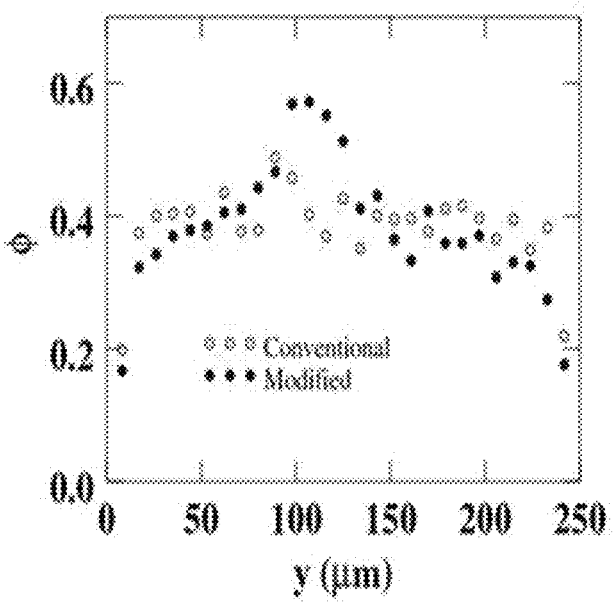
FIG. 6B illustrates particle concentration distributions in a Poiseuille dominant flow.
Figure 7A:
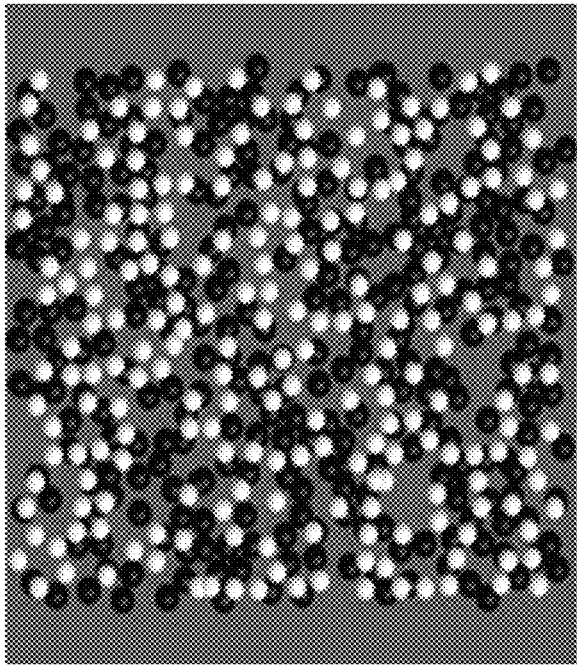
FIG. 7A illustrates particle distributions over a film obtained with a Couette dominant flow according to the related art.
Figure 7B:
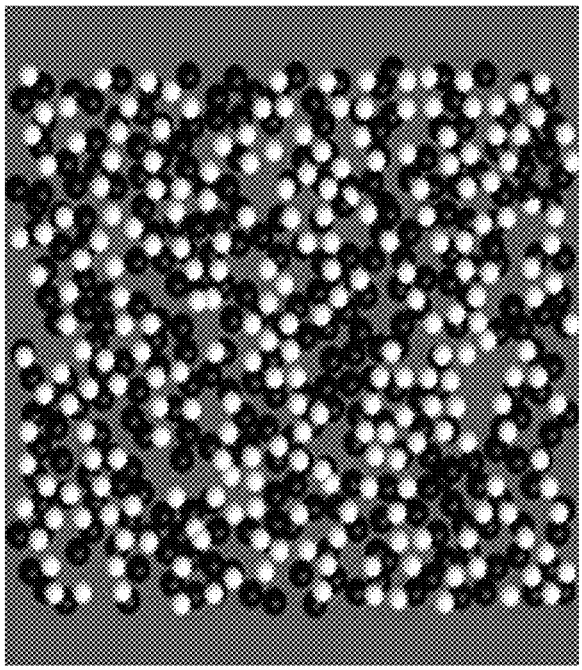
FIG. 7B illustrates particle distributions over a film obtained with a Couette dominant flow according to an embodiment of the invention.
Figure 8A:
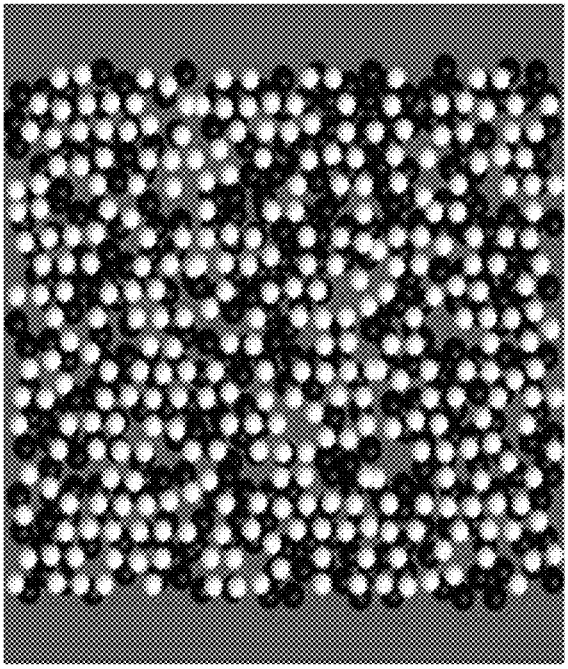
FIG. 8A illustrates particle distributions over a film obtained with a boundary flow according to the related art.
Figure 8B:
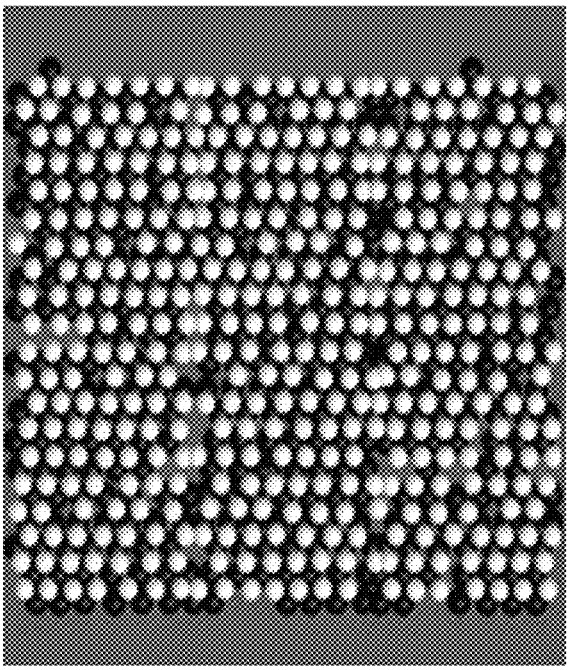
FIG. 8B illustrates particle distributions over a film obtained with a boundary flow according to an embodiment of the invention.
Figure 9A:
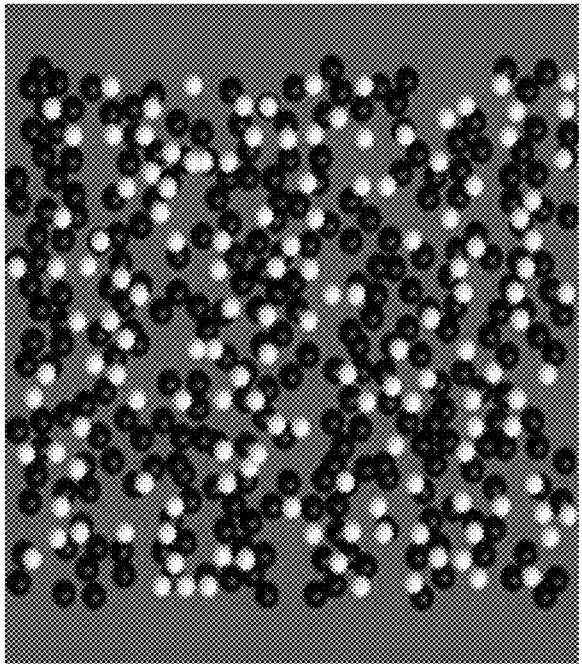
FIG. 9A illustrates particle distributions over a film obtained with a Poiseuille dominant flow according to the related art.
Figure 9B:
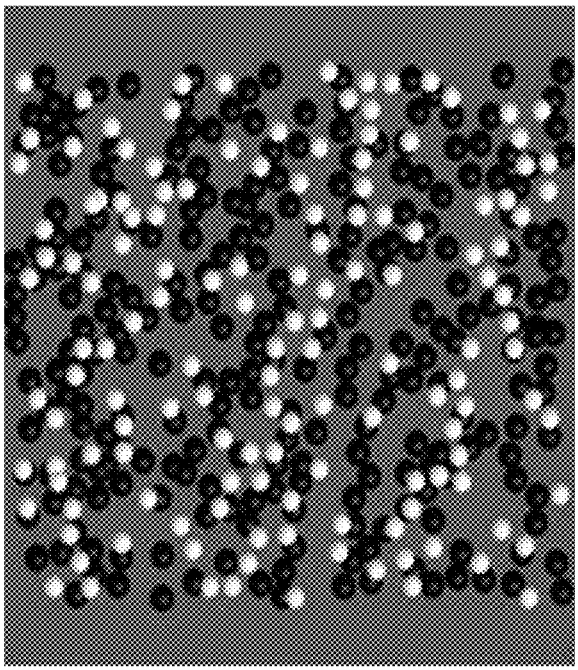
FIG. 9B illustrates particle distributions over a film obtained with a Poiseuille dominant flow according to an embodiment of the invention.

It is observed that the results of calculating the distribution of particles according to the related art and according to an embodiment of the invention may follow the graphs of FIG. 4B, FIG. 5B, and FIG. 6B. It can be observed, in particular, that whereas the plots for the Couette dominant flow do not have areas of especially high concentration, the plots for the boundary flow and the Poiseuille dominant flow have distributions of high concentrations at the side near the substrate surface (y=0) and the side below the center (y/H<0.5), respectively.

Such phenomena are distinctly observable in the plots associated with a slot coating apparatus according to the embodiment of the invention.

FIGS. 7A to 9A and FIGS. 7B to 9B are plan views showing how the particles are aligned at a region within 20 μm above the substrate surface (0<y<20 μm). To differentiate the particles formed in the two layers, the particles of the first layer are represented in white, and the particles of the second layer are represented in black. As regards the particle distributions, it can be seen that for Couette dominant flow or the Poiseuille dominant flow, random arrangements are obtained with both the apparatus based on the related art and the apparatus based on an embodiment of the invention. However, in FIG. 8B, it can be observed that the improved design provides a well packed particle coating under the boundary flow condition, where the particles form 2-dimensional hexagonal arrays.

As set forth in the empirical examples and drawings described above, an embodiment of the invention provides a coating bead cover in a particular length at one side of the first slot die and uses the dimensionless variable shown in Equation 1 to maintain a Couette-Poiseuille flow, i.e. boundary flow, through a long section when coating a substrate with a solution containing a high concentration of particles (particle volume percentage of 20% or higher).

According to this embodiment, the length L of the coating bead cover may be made proportional to the size H of the coating gap, such that the fraction L/H is limited to within 10~2000. It may be preferable to keep L greater than or equal to 100H and smaller than or equal to 1000H.

Also, to allow the particles to crystallize over the substrate, the G value of Equation 1 may suitably be kept around 1. More specifically, it may be preferable to keep G greater than or equal to 0.8 and smaller than or equal to 1.2.

In Equation 1 above, $\eta_s$ is a physical property of the fluid that is directly related to the quality of the final product, such as in terms of the amount of dried residue, and thus may not readily be altered. The gap size H is also directly associated with the final thickness of the coated product and thus may not readily be altered, either. Therefore, the G value may be adjusted to a desired value by changing the pressure gradient ∇p or either the flow rate of the feed or the speed $u_w$ of the substrate, which may be considered equivalent variables, as the G value can be expressed as a fractional relationship between the above variables.

The embodiments of the invention set forth above are disclosed for illustrative purposes only. A person of ordinary skill in the art would be able to make various modifications, alterations, and additions without departing from the spirit and scope of the invention, and such modifications, alterations, and additions are to be interpreted as being encompassed within the scope of claims set forth below.

What is claimed is:

1. A slot coating apparatus configured to coat a coating liquid containing a high concentration of particles over a substrate, the slot coating apparatus comprising:

a first slot die arranged at a downstream side of the coating liquid;

a second slot die arranged at an upstream side of the coating liquid, the second slot die positioned facing a first surface of the first slot die;

a coating bead cover extending from a second surface of the first slot die opposite to the first surface along a movement direction of the substrate; and a pressurizing box disposed at the second slot die side and configured to form a pressure gradient between the downstream and the upstream by providing a pressure lower or higher than an atmospheric pressure.

2. The slot coating apparatus of claim 1, wherein a length (L) of the coating bead cover is proportional to a coating gap size (H), the coating gap size representing a distance between a die lip of the first slot die and second slot die and a surface of the substrate.

3. The slot coating apparatus of claim 2, wherein the L is within a range of 10H to 2000H.

4. The slot coating apparatus of claim 2, wherein the L is within a range of 100H to 1000H.

5. The slot coating apparatus of claim 1, wherein a length (L) of the coating bead cover is varied according to the pressure gradient and a movement speed of the substrate.

6. The slot coating apparatus of claim 1, wherein a flow of the coating liquid is classified as a Couette flow, a boundary flow, and a Poiseuille flow based on a dimensionless variable affected by the pressure gradient, a coating gap size (H) representing a distance between a die lip of the first slot die and second slot die and a surface of the substrate, a substrate movement speed, and a slurry viscosity.

7. The slot coating apparatus of claim 6, wherein the dimensionless variable is expressed as an equation shown below:

$$G = \frac{\nabla p H^2}{u_w \eta_s}$$

where $\nabla p$ is a pressure gradient along an axial direction, H is a gap size between the die lip and the substrate, $u_w$ is the substrate movement speed (web speed), and $\eta_s$ is a viscosity of a slurry (suspension).

8. The slot coating apparatus of claim 7, wherein the dimensionless variable is determined as a value within a range of 0.8 to 1.2 for crystallization of the particles of the coating liquid.

9. The slot coating apparatus of claim 8, wherein the dimensionless variable is adjusted by adjusting the pressure gradient or the movement speed of the substrate.

10. The slot coating apparatus of claim 1, wherein the coating liquid contains particles having particle volume percentage of 20% or higher.

11. The slot coating apparatus of claim 1, wherein the coating liquid maintains a Couette-Poiseuille flow in a region where the coating bead cover is extended.

* * * * *